US005692295A

United States Patent [19]

Dahl

[11] Patent Number: 5,692,295

[45] Date of Patent: Dec. 2, 1997

[54] APPARATUS FOR PRODUCING AN END CLOSURE

[75] Inventor: Erik Dahl, Solvesborg, Sweden

[73] Assignee: Valeo Engine Cooling AB, Solvesborg, Sweden

[21] Appl. No.: 499,810

[22] Filed: Jul. 10, 1995

[30] Foreign Application Priority Data

Jul. 12, 1994 [SE] Sweden ..... 9402474

[51] Int. Cl.[6] ..... B23P 15/00

[52] U.S. Cl. ..... 29/819; 29/417; 29/727; 29/890.053

[58] Field of Search ..... 29/417, 799, 782, 29/819, 726, 727, 773, 890.053

[56] References Cited

U.S. PATENT DOCUMENTS

| | | | |
|---|---|---|---|
| 3,847,058 | 11/1974 | Jesevich et al. | 29/243.517 |
| 4,580,328 | 4/1986 | Klaschka | 29/243.517 |
| 4,974,316 | 12/1990 | Suzuki et al. | 29/773 |
| 5,129,246 | 7/1992 | Strickland et al. | 72/21 |
| 5,367,759 | 11/1994 | Loew et al. | 29/243.517 |
| 5,444,908 | 8/1995 | Kazino | 29/243.517 |

*Primary Examiner*—Irene Cuda
*Attorney, Agent, or Firm*—Morgan & Finnegan, LLP

[57] ABSTRACT

The described apparatus produces an end closure for a pipe that forms part of a heat exchanger. The apparatus includes a frame, with first and second sides. A tubular through-channel has an opening on the first said that is delimited by a side surface extending around the opening. It is possible for a pipe which is intended to be closed, to be introduced into the tubular channel from the second side. A press tool executes a reciprocal motion through the channel. The press tool presses an end closure blank into the channel opening. A method for producing an end closure for a heat exchanger pipe also is described. The method comprises the measures of introducing a pipe into a channel in a frame. An end closure blank is pressed into the through-channel and on into the pipe. The blank, by engagement with the side surface of the frame, and thereafter with the inner limit surfaces of the channel is shaped to give a cup-shaped end closure which, with its aperture directed outward from the pipe end, fits into the latter.

8 Claims, 1 Drawing Sheet

APPARATUS FOR PRODUCING AN END CLOSURE

FIELD OF THE INVENTION

The invention relates to an apparatus for producing an end closure for a pipe which forms part of a heat exchanger and a method for producing an end closure for a pipe which forms part of a heat exchanger.

BACKGROUND OF THE INVENTION

Heat exchangers are often constructed in the form of a heat exchanger stack with inlets and outlets for a heat exchanger fluid, these being made of aluminum. The heat exchanger stack often consists of a number of pipes which are placed one on top of the other, or one behind the other, and which between them have surface-increasing elements or so-called ranks.

In certain types of heat exchangers, such as an oil cooler of the type which is intended to be placed inside the tank of a conventional vehicle radiator, and which is mentioned in the preferred illustrative embodiments hereinafter, it is necessary to close the end apertures of the pipes.

One means of producing an end closure is to introduce into the end aperture a solid aluminum block which is arranged to bear sealingly against the insides of the end aperture. However, such a solution has a number of disadvantages. A solid block entails considerable material consumption, and since the costs of material constitute a major part of the overall costs, this is something to be avoided. Moreover, the substantial difference in material thickness between the solid block and the end aperture means that soldering problems occur.

There is therefore a need for a solution which is an improvement on the prior art.

One object of the invention is to provide an apparatus and specify a method for producing an end closure for a pipe which forms part of a heat exchanger, which end closure permits a low consumption of material and can be connected to the pipe by hard soldering.

Another object of the invention is to produce an apparatus and specify a method for producing an end closure which is self-fixing in the end aperture of the pipe.

DISCLOSURE OF THE INVENTION

According to a first aspect of the present invention there is provided an apparatus for producing an end closure for a pipe which forms part of a heat exchanger, the apparatus comprising a frame which has a first side and a second side situated opposite the first side, and a tubular channel which runs from the first side to the second side and whose opening on said first side is delimited by a side surface extending around the opening, it being possible for a pipe, which is intended to be closed, to be introduced into the tubular channel from said second side. A press tool which is arranged to execute a reciprocal motion through the channel from the first side of the frame; the press tool being arranged, by virtue of its forwardly directed movement, to press an end closure blank into the opening of the channel, by engagement between the end closure blank and the side surface of the frame, to form a cup-shaped end closure. The press tool thereafter pushes the cup-shaped end closure through the channel and into the pipe introduced from the second side, with the aperture of the end closure being directed outward from the pipe end, and the press tool and the channel having such a shape that the end closure fits into the pipe end.

According to a second aspect of the present invention there is provided a method for producing an end closure for a pipe which forms part of a heat exchanger. The method still comprises the following steps:- introducing a pipe intended for closure into a channel in a frame which has a first side and a second side situated opposite the first side, and a tubular channel which runs from the first side to the second side and whose opening on the first side is delimited by a side surface extending around the opening; pressing an end closure blank into the through-channel and pushing the blank through the channel and on into the pipe, with the blank, by engagement with the side surface of the frame and thereafter with the inner limit surfaces of the channel, being shaped to give a cup-shaped end closure which, with its aperture directed outward from the pipe end, fits into the latter.

Features of the invention are specified in the subordinate patent claims.

The invention provides that the end closure can be pushed into the end aperture of the pipe with press-fitting, which permits self-fixing of the end closure in the pipe, which fact is of great advantage in the subsequent hard-soldering operation.

The special shape of the end closure also means that the solder seam between the end closure and the inside of the pipe is long, which on the one hand ensures a strong connection and on the other hand ensures a good closure and thus sealing. The sealing requirements are very stringent, especially in the abovementioned application, where an oil cooler is placed in the tank on a vehicle radiator. It will be appreciated that there can be devastating consequences if liquid in the form of water and glycol is allowed to leak into the oil cooler and mix with the oil.

BRIEF DESCRIPTION OF THE DRAWINGS

A preferred embodiment of the invention will now be described with reference to the drawings, in which.

In the drawings, like reference numerals refer to like parts.

DESCRIPTION OF THE PREFERRED EMBODIMENT

Figure 2:
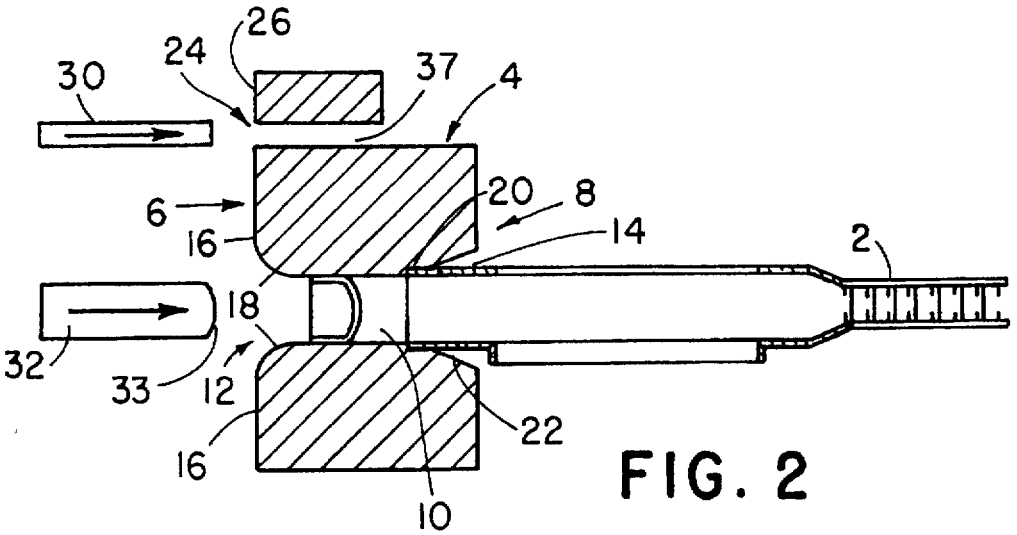
FIG. 2 is a side view, partly in section, of an apparatus according to the invention, where certain parts have been cut away for reasons of clarity.

FIG. 2 shows an apparatus according to the invention for producing an end closure for an aluminum pipe 2, which apparatus has a frame 4 with a first side or front side 6 and a second side or rear side 8, where the rear side 8 is situated opposite the front side 6, as is seen clearly from FIG. 2. The frame is furthermore designed with a substantially rectangular, tubular through-channel 10 which extends from the front side 6 to the rear side 8 and which has an inlet opening 12 on the front side 6 and an outlet opening 14 on the rear side 8. The inlet opening 12 of the channel 10 is delimited by a plane, front side surface 16 which extends around the opening and which merges with the channel 10 via a curved circumferential transition surface 18, which is also evident from FIG. 2.

The channel 10 is furthermore designed with a circumferential shoulder 20 which is situated in the central portion of the channel, slightly offset toward its outlet opening 14, and it has a conical portion 22 extending from the shoulder to the outlet opening.

The apparatus furthermore has a conventional punch member 24 which is coupled to the frame 4 and which consists of a die 26 whose front side is situated in line with the front side 6 of the frame 4, and one part of which consists of an upper part of the frame 4, and a punch tool 30 which executes a reciprocating motion and is driven by a drive apparatus (not shown). The die 26 furthermore has a through-channel 31 which extends from the front side of the die 26 to the rear side of the die and through which the punch tool 30 is arranged to move.

Figure 1:
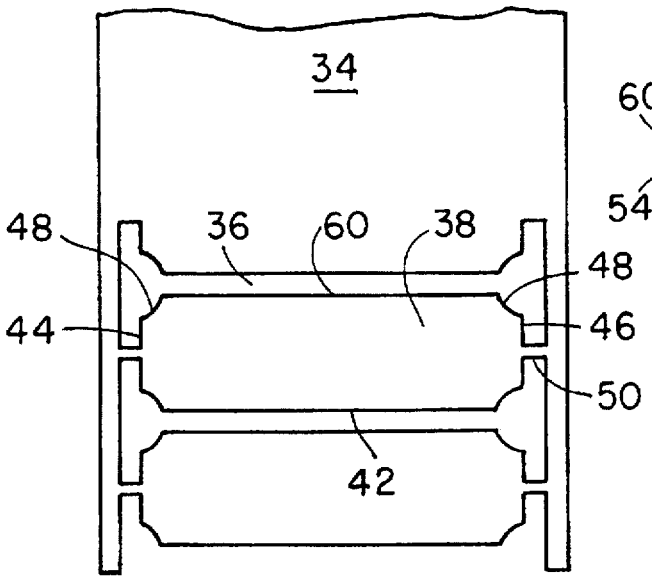
FIG. 1 is a plan view of a metal tape and two end closure blanks, according to the invention, which are connected to the metal tape

The apparatus additionally has a press tool 32 which executes a reciprocating motion through the channel 10 in the frame 4 and which is driven by a drive apparatus (not shown), and an aluminum tape supply (not shown) with a flat aluminum tape 34, of which a section is shown in FIG. 1. The press tool 32 has a cross section which is slightly smaller than that of the channel 10 but which otherwise corresponds with said channel 10. The press tool 32 has a front end 33 which is slightly convex to permit a gentle inward pressing.

The function of the apparatus and the method for producing an end closure according to the invention will be described hereinbelow.

The pipe 2, which has an end portion of substantially rectangular cross section, is introduced into the channel 10 of the frame 4 through the outlet opening on the rear side 8, and is pushed into the channel 10, with the outside of the pipe bearing against the inside of the channel 10, until the end edge of the pipe is located in contact with the circumferential shoulder 20 of the channel 10. The shoulder 20 is in this case slightly wider than the wall thickness of the pipe for the purpose of receiving the side edges of the end closure, in a manner which is described below.

The aluminum tape 34 is collected from the aluminum tape supply and is first fed, by means of a feed device (not shown), forward to the punch member where the sheet extends along, and is pressed against, the front side of the die. Thereafter, material sections 36 are punched out from the aluminum tape in a shape corresponding to an I-beam which lies in the transverse direction of the tape, and which is evident from FIG. 1, for the purpose of forming an end closure blank 38. It is also evident from FIG. 1 that the blank has a substantially rectangular shape with two long sides 40, 42 in the transverse direction of the tape, and two short sides 44, 46 in the longitudinal direction of the tape. The transition portion between the long and short sides of the blank 38 is drawn in to form gentle inwardly curved corners 48. It is also evident from FIG. 1 that the blank is connected to the aluminum tape via two material strips 50 located in the middle of the short sides and opposite each other.

The aluminum tape is thereafter advanced along the front side 6 of the frame 4 until one of the end closure blanks 38 is situated centrally in front of the inlet opening 12 of the channel 10, with the end closure blank 38 bearing along its long and short sides against front side surface 16 of the frame 4.

Figure 3A:
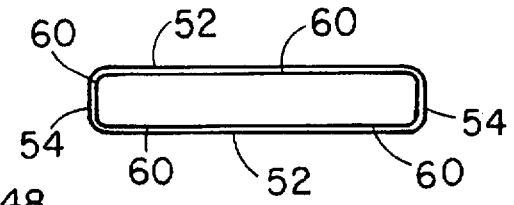
FIG. 3*a* is a view, from straight in front, of a finished end closure according to the invention.
Figure 3B:
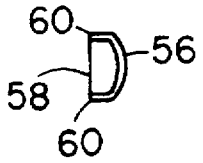
FIG. 3*b* is a side view of the finished end closure in FIG. 3*a*.

The press tool 32 which executes a reciprocating motion then presses the end closure blank 38 into the channel 10 by means of its forwardly directed linear movement and a substantially centered engagement with the end closure blank. The blank 38 is at this point broken off from the aluminum tape 34, and portions of the long and short sides of the blank 38 bear against, and follow, the curved transition surface 18 of the channel until the blank is situated completely inside the channel. The blank is deformed during this process and shaped to give a cup-shaped or box-shaped end closure with two plane long sides 52, two plane short sides 54, and a bottom 56 which is slightly convex. The cup-shaped end closure also has an aperture 58, which is delimited by side edges 60. The end closure is thereby given a cross section corresponding to the cross section of the channel and of the press tool. The shape of the end closure is clearly evident from FIGS. 3*a* and *b*.

The end closure is then pushed further forward into the channel 10 until its aperture 58 is situated level with the shoulder 20, the side edges 60 of the end closure snapping past the shoulder 20 so that the side edges bear against the shoulder 20, which is made possible by the fact that the shoulder 20 is wider than the wall thickness of the pipe 2. In this position, the end closure is situated inside the end of the pipe and closes its end aperture, with its own aperture directed outward from the pipe end. The sides of the end closure in this case bear tightly against the inside of the pipe along their respective plane portions, which fact allows the end closure to be connected to the pipe by hard soldering in a vacuum furnace.

The press tool is then pulled back out of the channel 10, the end closure remaining in the pipe as a result of engagement between the side edges 60 of the end closure and the shoulder 20. The pipe is then removed from the frame 4 and moved to a downstream production stage or turned around for closing the other end of the pipe. The sequence described above can then be repeated for closing the next pipe end.

It will be appreciated that the invention can be modified in a number of ways within the scope of protection defined in the independent patent claims. The pipe end and consequently the end closure need not have a rectangular cross section, and they can instead have, for example, a circular or oval cross section. The punching operation need not be carried out in conjunction with the pressing operation, and instead can be carried out separately. The end closure blanks can be punched out completely from the tape and then fed, for example via a magazine, to the frame for pressing them into the channel of the frame.

What we claim is:

1. An apparatus for producing from an end closure blank an end closure having an aperture for a pipe end which forms part of a heat exchanger, said apparatus comprising:

a frame which has a first side having an opening therein and a second side having another opening therein situated opposite said first side, and a tubular channel which extends from said first side opening to said second side opening, the opening on said first side is delimited by a side surface extending around the opening for receiving the pipe end in said tubular channel from said second side;

a press tool for reciprocal motion within said channel from said first side of said frame;

said press tool being able to press the end closure blank into said first side opening of said channel by engagement between the end closure blank and said side surface of said frame to form the end closure with the aperture, and to push the end closure within said channel and into the pipe end with the aperture of the end closure being directed outward from the pipe end, and said press tool and said channel having complementary shapes that enable said end closure to fit within the pipe end.

2. The apparatus as claimed in claim 1, wherein the pipe end has an edge, said tubular through-channel has an inner circumferential shoulder for engaging said pipe end edge, and the end closure is pushed through the channel until the end closure aperture is at least aligned with the shoulder.

3. The apparatus as claimed in claim 1, wherein the pipe has a wall thickness, said shoulder has a width which exceeds said wall thickness of the pipe, the end closure bearing against said shoulder.

4. The apparatus as claimed in claim 1, wherein the side surface has a curved transition surface to merge said side surface to said tubular channel.

5. An apparatus for producing from an end closure blank an end closure having an aperture, for a pipe end which forms part of a heat exchanger, the apparatus comprising:

a frame which has a first side having an opening therein and a second side having another opening therein situated opposite said first side, and a tubular channel which extends from said first side opening to said second side opening and said opening on said first side is delimited by a side surface extending around the opening for receiving the pipe end in said tubular channel from said second side;

a press tool for reciprocal motion within said channel from said first side of said frame;

said press tool being able to press the end closure blank into said first side opening of said channel by engagement between the end closure blank and said side surface of said frame to form the end closure with the aperture, and to push the end closure within said channel and into the pipe end with the aperture of the end closure being directed outward from the pipe end, and said press tool and said channel having complementary shapes that enable said end closure to fit within the pipe end, wherein the apparatus has a metal tape and a member for cutting metal tape material out from said metal tape in order to form the end closure blank.

6. The apparatus as claimed in claim 5, wherein said metal tape, extends along said first side of the frame, across said first side opening of said channel between said press tool and said frame.

7. The apparatus as claimed in claim 5, wherein said member for cutting out said metal tape material has a punch member said punch member being coupled to said frame.

8. The apparatus as claimed in claim 5, wherein the flat end closure blank, is connected to said metal tape by means of two metal material strips that are breakable by said press tool.

* * * * *